United States Patent [19]

Fujimoto et al.

[11] Patent Number: 5,052,357

[45] Date of Patent: Oct. 1, 1991

[54] INTAKE AIR MOUNT CONTROL SYSTEM FOR INTERNAL COMBUSTION ENGINES

[75] Inventors: Sachito Fujimoto; Masakazu Kitamoto, both of Wako, Japan

[73] Assignee: Honda Giken Kogyo Kabushiki Kaisha, Tokyo, Japan

[21] Appl. No.: 578,582

[22] Filed: Sep. 6, 1990

[30] Foreign Application Priority Data

Sep. 8, 1989 [JP] Japan ..... 1-106004[U]

[51] Int. Cl.[5] ..... F02M 3/00

[52] U.S. Cl. ..... 123/339

[58] Field of Search ..... 123/339, 585, 489, 440

[56] References Cited

U.S. PATENT DOCUMENTS

| | | | |
|---|---|---|---|
| 4,856,475 | 8/1989 | Shimpmura et al. | 123/339 |
| 4,862,851 | 9/1989 | Washino et al. | 123/339 |
| 4,864,997 | 9/1989 | Miyachi | 123/489 |
| 4,877,002 | 10/1989 | Shimomura et al. | 123/339 |
| 4,884,540 | 12/1989 | Kishimoto et al. | 123/339 |
| 4,976,238 | 12/1990 | Toyoda | 123/339 |
| 4,986,236 | 1/1991 | Kobayashi | 123/339 |

*Primary Examiner*—Raymond A. Nelli
*Attorney, Agent, or Firm*—Lyon & Lyon

[57] ABSTRACT

An intake air amount control system for an internal combustion engine includes a control valve for regulating the amount of intake air supplied through the intake pipe to the engine. An ECU determines the difference between a desired idling rotational speed of the engine and an actual rotational speed of same and feedback-controls the control valve by means of a control amount responsive to the determined difference such that the actual rotational speed becomes equal to the desired idling rotational speed. The ECU learns a reference value of the control amount by calculating an average value of values of the control amount applied during the feedback control. The ECU inhibits the learning of the reference value of the control amount when the difference between atmospheric pressure and absolute pressure within the intake pipe is smaller than a predetermined value.

7 Claims, 5 Drawing Sheets

INTAKE AIR MOUNT CONTROL SYSTEM FOR INTERNAL COMBUSTION ENGINES

BACKGROUND OF THE INVENTION

This invention relates to an intake air amount control system for internal combustion engines, and more particularly to a system of this kind which is adapted to learn values of the control amount used for controlling the intake air amount during feedback control of idling rotational speed of the engine.

A control system for controlling the amount of intake air supplied to an internal combustion engine is known e.g. from Japanese Provisional Patent Publication (Kokai) No. 61-258947, which comprises valve means for regulating the amount of intake air supplied to the engine through the intake pipe, control means for determining the difference between a desired idling rotational speed of the engine and the actual rotational speed of same and controlling the valve means in a feedback manner responsive to the determined difference such that the actual engine rotational speed becomes equal to the desired idling rotational speed, and learning means for calculating an average value of values of a feedback control amount applied during the feedback control and adapting the calculated average valve as a reference value of the control amount, i.e. learn the reference value, and wherein the reference value is applied as an initial value of the control amount when the next feedback control is started.

The valve means generally comprises a control valve which is arranged in a bypass passage bypassing a throttle valve in the intake pipe for supplying auxiliary air to a downstream side of the intake pipe. The control valve usually comprises a linear solenoid valve which opens to a degree proportional to the amount of driving current applied thereto.

The learning of the reference value of the control amount for feedback control should be carried out when the control system including the engine is in a steady state. If the learning is carried out when the control system is in an unsteady state such as a transient state, or in a state where the control amount assumes values different from those assumed during the feedback control, such as when an external load is applied to the engine, e.g. by the air conditioner installed in the vehicle equipped with the engine, the learned reference value will assume an improper value. Particularly, when the vehicle is running at a high altitude, there is a decrease in the difference $\Delta P$ between atmospheric pressure $P_A$ and absolute pressure $P_{BA}$ within the engine intake pipe on the downstream side of the throttle valve, so that the speed of intake air flow lowers. Consequently, the actual flow rate of intake air is largely different with reference to the amount of driving current (command current) for opening the control valve from a normal value. Therefore, if learning of the reference value of control amount is carried out with the decreased pressure difference $\Delta P$, the learned reference value will assume an improper value.

More specifically, referring to FIG. 4, let it be assumed that an amount Q1 of air is to be supplied to the engine. When the pressure difference $\Delta P$ assumes a normal value of 300 mmHg or larger, the required command current amount $I_{CMD}$ for the control valve is $I_1$. However, when the pressure difference $\Delta P$ is 200 mmHg, the required command current amount $I_{CMD}$ increases to $I_2$. When the pressure difference $\Delta P$ is 100 mmHg, the required command current amount $I_{CMD}$ increases to a value as large as $I_3$. With such a characteristic of command current amount vs. air amount, when the pressure difference $\Delta P$ is as small as 100 mmHg, the command current amount $I_3$ is learned as a reference value of the feedback control amount. If this learned reference value is applied at the start of the next feedback control executed when the pressure difference $\Delta P$ assumes a normal value of 300 mmHg or larger, an excessive air amount Q3 will be supplied to the engine based on the learned reference value.

The known control system carries out learning of the reference value even when the pressure difference $\Delta P$ is small, so that an incorrect or excessive amount of air is supplied to the engine during the next feedback control executed when the pressure difference $\Delta P$ is normal or large.

SUMMARY OF THE INVENTION

It is the object of the invention to provide an intake air amount control system for internal combustion engines, which is capable of preventing erroneous learning of a reference value of feedback control amount during feedback control of the idling rotational speed of the engine.

To attain the above object, the present invention provides an intake air amount control system for an internal combustion engine having an intake pipe, the system including valve means for regulating an amount of intake air supplied through the intake pipe to the engine, control means for determining a difference between a desired idling rotational speed of the engine and an actual rotational speed of same, and feedback-controlling the valve means by means of a control amount responsive to the determined difference such that the actual rotational speed becomes equal to the desired idling rotational speed, and learning means for learning a reference value of the control amount, by calculating an average value of values of said control amount applied during the feedback control.

The intake air amount control system according to the present invention is characterized by an improvement comprising inhibiting means for inhibiting the learning of the reference value of the control amount when a difference between atmospheric pressure and absolute pressure within the intake pipe is smaller than a predetermined value.

The valve means is a valve of a type adapted to open to a degree commensurate with a current amount supplied thereto, and the control amount comprises the current amount.

Preferably, the valve means may be a linear solenoid valve adapted to open to a degree proportional to the current amount supplied thereto.

The linear solenoid valve may be arranged in an auxiliary air passage bypassing a throttle valve in the intake pipe, to control the flow rate of air passing therethrough.

Alternatively, the valve means may comprise the throttle valve.

Preferably, the control amount is an integral term which is determined in response to a difference between the desired idling rotational speed of the engine and the actual rotational speed of same.

The learned reference value of the control amount may be applied as an initial value of the control amount at the start of the feedback control.

The above and other objects, features, and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
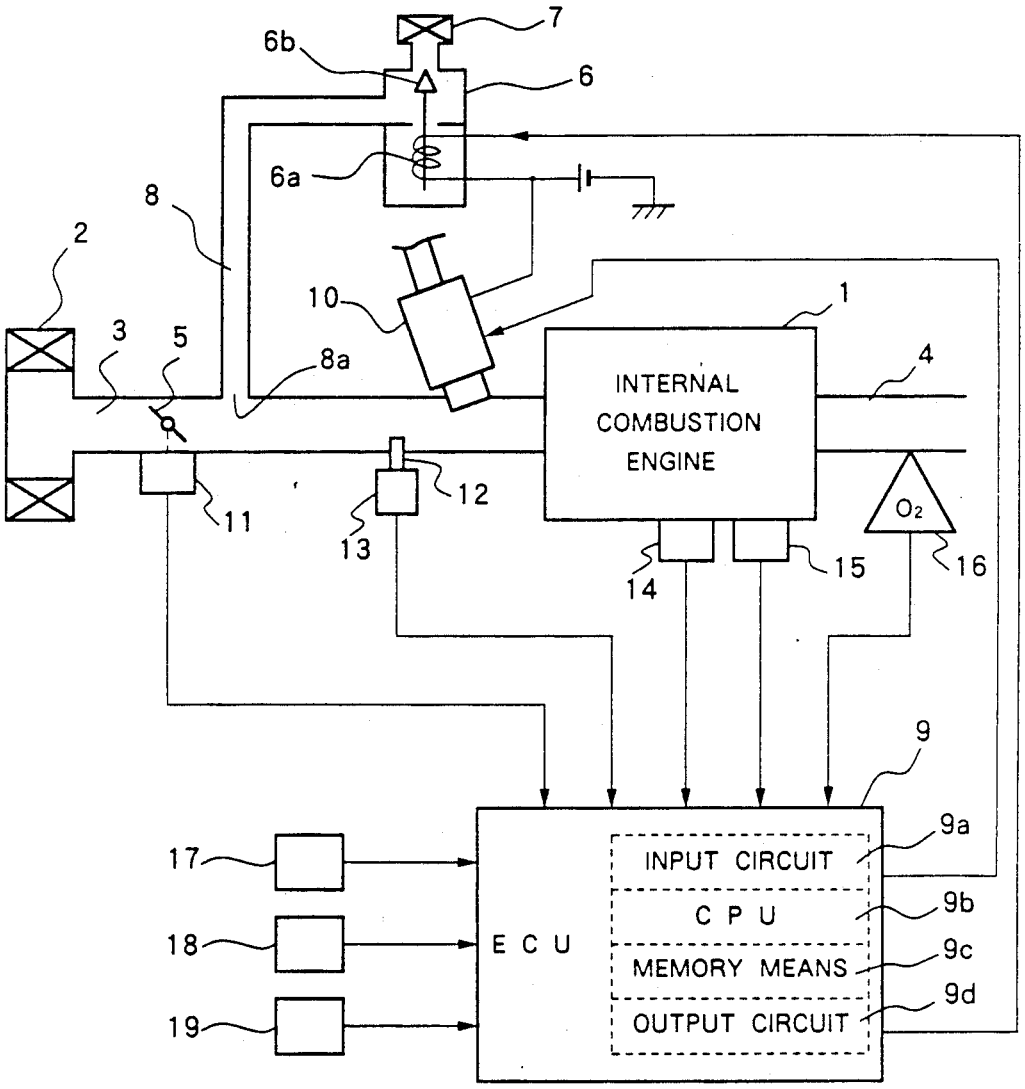
FIG. 1 is a block diagram illustrating the whole arrangement of an intake air amount control system for an internal combustion engine according to the invention.

Referring first to FIG. 1, there is schematically illustrated the whole arrangement of a fuel supply control system including an intake air amount control system for an internal combustion engine, according to an embodiment of the invention. In FIG. 1, reference numeral 1 designates an internal combustion engine which may be a four-cylinder type, and to which are connected an intake pipe 3 with an air cleaner 2 mounted at its open end, and an exhaust pipe 4, at an intake side and an exhaust side of the engine 1, respectively. A throttle valve 5 is arranged within the intake pipe 3, and a bypass passage 8 opens at its open end 8*a* into the intake pipe 3 at a location downstream of the throttle valve 5, and communicates with the atmosphere at its other end mounted with an air cleaner 7. Arranged across the bypass passage 8 is a control valve 6 for controlling the amount of auxiliary air to be supplied to the engine 1 through the bypass passage 8. The control valve 6 is a normally-closed type electromagnetic valve which is adapted to open to a degree proportional to the amount of driving current I applied thereto, and which comprises a linear solenoid 6*a*, and a valve body 6*b* which opens the bypass passage 8 during energization of the solenoid 6*a*. The solenoid 6*a* is electrically connected to an electronic control unit (hereinafter called "the ECU") 9, which controls the current amount I to be supplied to the solenoid 6*a* to thereby control the opening degree of the control valve 6.

Fuel injection valves 10, only one of which is shown, are arranged in a manner projected into the interior of the intake pipe 3 at a location between the engine 1 and the open end 8*a* of the bypass passage 8. The fuel injection valves 10 are connected to a fuel pump, not shown, and also electrically connected to the ECU 9.

A throttle valve opening ($\theta_{TH}$) sensor 11 is connected to the throttle valve 5, an intake pipe absolute pressure ($P_{BA}$) sensor 13 is provided in communication through a conduit 12 with the interior of the intake pipe 3 at a location downstream of the open end 8*a* of the bypass passage 8, and an engine coolant temperature ($T_W$) sensor 14 is mounted in the cylinder block of the engine 1, and electrically connected to the ECU 9.

An engine rotational speed (Ne) sensor 15 is arranged in facing relation to a crankshaft or a camshaft of the engine and generates one pulse (hereinafter called "TDC signal pulse") at a particular crank angle position of each of the engine cylinders, which is in advance of the top-dead-center position (TDC) of a piston in the cylinder immediately before the start of its suction stroke by a predetermined crank angle, whenever the engine crankshaft rotates through 180 degrees. Pulses of the TDC signal generated by the Ne sensor 15 are supplied to the ECU 9.

An $O_2$ sensor 16 is provided in the exhaust pipe 16 for detecting the concentration of oxygen in exhaust gases emitted from the engine. The detected $O_2$ concentration signal is supplied to the ECU 9.

Further electrically connected to the ECU 9 are an atmospheric pressure ($P_A$) sensor 17 for detecting atmospheric pressure, and a vehicle speed (V) sensor 18 for detecting the speed of a vehicle in which the engine is installed, outputs from the sensors 17 and 18 being supplied to the ECU 9.

Further electrically connected to the ECU 9 are a power steering switch, an air conditioner switch, and other sensors and switches, generically designated by 19.

The ECU 9 comprises an input circuit 9*a* having functions of shaping waveforms of pulses of input signals from various sensors, shifting voltage levels of input signals from analog-output type sensors, and converting analog values of the input signals into digital signals, etc, a central processing unit (hereinafter called "the CPU") 9*b*, memory means 9*c* storing various operational programs to be executed within the CPU 9*b* as well as for storing various calculated data from the CPU 9*b*, and an output circuit 9*d* for supplying driving signals to the fuel injection valves 10 and the control valve 6.

The ECU 9 operates in response to engine parameter signals supplied from various sensors to determine operating conditions of the engine 1, calculate in a known manner a fuel injection period for which the fuel injection valves 10 should be opened, calculate a value opening command value (a current amount) $I_{CMD}$, which determines the amount of auxiliary air, to be supplied to the linear solenoid 6*a* of the control valve 6 (hereinafter merely called "the current amount $I_{CMD}$") in accordance with a control program, hereinafter described, and supply respective driving signals corresponding, respectively, to the calculated fuel injection period and the current amount $I_{CMD}$ to the fuel injection valve 10 and the control valve 6 through the output circuit 9*d*.

More specifically, the ECU 9 calculates the current amount $I_{CMD}$ to be supplied to the control valve 6 by the use of the following equation (1):

$$I_{CMD}=(I_{FBn}+I_{EX})\times K_{PAD}+I_{PA} \quad (1)$$

where $I_{FBn}$ represents a feedback control value which is determined by a control program of FIG. 2 for determining the auxiliary air amount, hereinafter described.

$I_{EX}$ is an external load-dependent correction term which is determined based on various external loads on the engine such as an electric load correction value determined by the magnitude of electric loads connected to a battery, a power steering correction value determined depending upon whether or not the power steering switch is on, a D range correction value determined depending upon whether or not the automatic transmission of the vehicle is in a D range, and an air conditioner correction value determined depending upon whether or not the air conditioner switch is on. $K_{PAD}$ is an atmospheric pressure-dependent correction coefficient which is set to such a value as to compensate for variation in the amount of auxiliary air supplied through the control valve 6 due to variation in atmospheric pressure. $I_{PA}$ is an atmospheric pressure-dependent correction value for Correcting variation in the amount of air supplied to the engine through air intake systems other than the control valve 6, such as the throttle valve 5 and a fast idle control valve, not shown, due to variation in atmospheric pressure.

The ECU 9 supplies a driving signal representing the calculated current amount $I_{CMD}$ to the control valve 6 to open same to a degree corresponding or proportional to the current amount $I_{CMD}$.

Further, the ECU 9 obtains a learned value (reference value) $I_{XREF}$ of the current amount I (feedback control amount) to be supplied to the control valve 6 during feedback control while the engine is in a predetermined idling condition, by the use of a subroutine, hereinafter described.

The manner of feedback-controlling the engine rotational idling speed according to the invention will now be explained with reference to FIG. 2.

Figure 2:
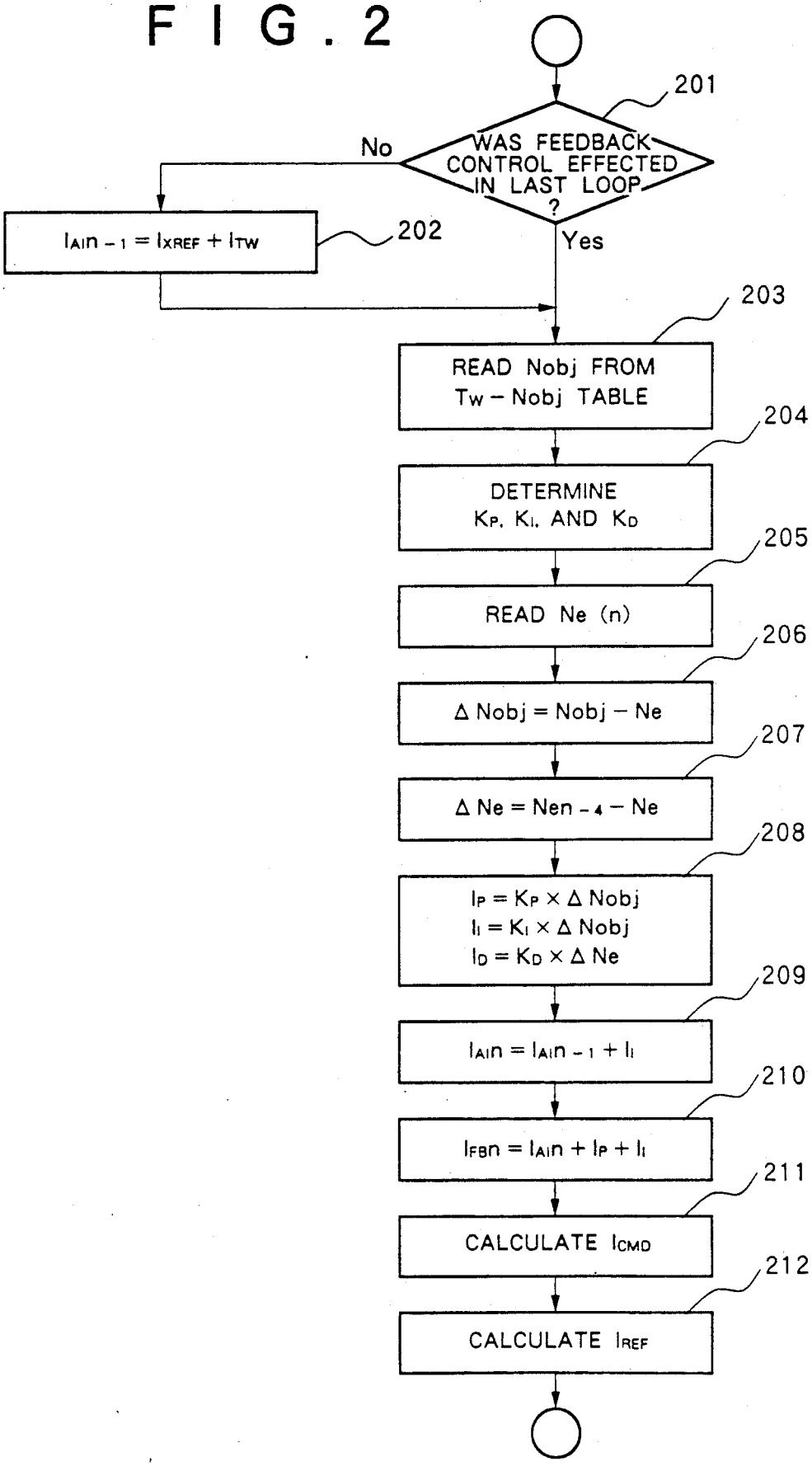
FIG. 2 is a flowchart of a program for carrying out feedback control of the idling rotational speed of the engine by controlling the intake air amount supplied to the engine.

FIG. 2 shows a program for determining the current amount $I_{CMD}$ to be supplied to the control valve 6, and obtaining a learned value or reference value $I_{XREF}$ of the feedback control amount I applied to feedback control of the idling rotational speed of the engine. This program is executed by the CPU 9b upon generation of each TDC signal pulse and in synchronism therewith. The feedback control of the idling rotational speed is executed by the present program when it is judged by a subroutine, not shown, that the engine is not in any of predetermined conditions in which open loop control should be effected.

First at a step 201 in the control program of FIG. 2, it is determined whether or not the engine was in a feedback control condition in the last loop, i.e. whether or not an integral term $I_{AIn-1}$ of the feedback control value $I_{FBn}$, which is determined at a step 209, hereinafter referred to, should be initialized in the present loop.

If the answer to the question of the step 201 is negative or No, that is, if the engine was not in the feedback control condition, that is, when the engine has just shifted from an open loop control condition to the feedback control condition in the present loop, the integral term $I_{AIn-1}$ is initialized at a step 202 in a manner hereinafter described, and then the program proceeds to a step 203 et seq. On the other hand, if the answer to the question of the step 201 is affirmative or Yes, that is, if the engine was in the feedback control condition in the last loop, the program directly proceeds to the step 203 et seq., without initializing the integral term $I_{AIn-1}$.

The initialization of the integral term $I_{AIn-1}$ at the step 202 is executed by adding a coolant temperature-dependent correction value $I_{TW}$, which is set in accordance with the temperature of engine coolant, to the learned value or reference value $I_{XREF}$ of the integral term $I_{AIn}$ obtained when the engine is in a predetermined operating condition, described hereinafter. The coolant temperature-dependent correction value $I_{TW}$ is read from a $T_W-I_{TW}$ table, not shown, stored in the memory means 9c. In the $T_W-I_{TW}$ table, the correction value $I_{TW}$ is set such that it generally decreases with increase in the engine coolant temperature $T_W$.

Then the program proceeds to steps 203 and 204, wherein a desired idling rotational speed Nobj is set, and the gain of feedback control is determined, respectively.

At the step 203, a value of the desired idling rotational Speed Nobj ($T_W$) is read from a $T_W$—Nobj table, not shown, stored in the memory means 9c, in accordance with the engine coolant temperature $T_W$. In the $T_W$—Nobj table, the desired idling rotational speed Nobj ($T_W$) is set such that it generally decreases with increase in the engine coolant temperature $T_W$.

At the step 204, respective values of a coefficient Kp for setting a proportional term control gain, a coefficient $K_I$ for setting an integral term control gain, and a coefficient $K_D$ for setting a differential term control gain are determined by a subroutine, not shown.

Then, the program proceeds to a step 205, wherein the actual engine rotational speed Ne detected by the Ne sensor 15 is read, followed by a step 206 wherein the difference ΔNobj between the desired idling rotational speed Nobj and the actual engine rotational speed Ne is determined, and a step 207 wherein the difference ΔNe between the actual engine rotational speed Ne in the present loop and the engine rotational speed $Ne_{n-4}$ detected in the loop preceding by 4 TDC pulses the present loop is determined.

At a step 208 following the step 207, there are obtained a proportional term $I_P$ and a differential term $I_D$ for determining the feedback control value $I_{FBn}$, and a correction term $I_I$ for correcting the integral term $I_{AIn}$, based on the coefficients $K_P$, $K_I$, $K_D$ obtained at the step 204, the difference ΔNobj obtained at the step 206, and the difference ΔNe obtained at the step 207. More specifically, the proportional term $I_P$ is determined by multiplying the difference ΔNobj by the coefficient $K_P$, the differential term $I_D$ by multiplying the difference ΔNe by the coefficient $K_D$, and the correction term $I_I$ by multiplying the difference ΔNobj by the coefficient $K_I$.

Then, the program proceeds to a step 209 wherein the integral term $I_{AIn}$ to be applied in the present loop is determined by adding the correction value $I_I$ obtained at the step 208 to the integral term $I_{AIn-1}$ which is one initialized at the step 202 or one obtained in the last loop. The proportional term $I_P$ and the differential term $I_D$ are further added to the determined integral term $I_{AIn}$ to obtain a feedback control value $I_{FBn}$ to be applied in the present loop, at a step 210. The obtained feedback control value $I_{FBn}$ is applied to the equation (1) for calculation of the command current amount $I_{CMD}$ to be supplied to the control valve, at a step 211.

Then, the program proceeds to a step 212, wherein the learned value or reference value $I_{XREF}$ of control amount is determined based on the integral term $I_{AIn}$ obtained at the step 209, by the use of the subroutine of FIG. 3, hereinafter explained, followed by termination of the program.

Figure 3A:
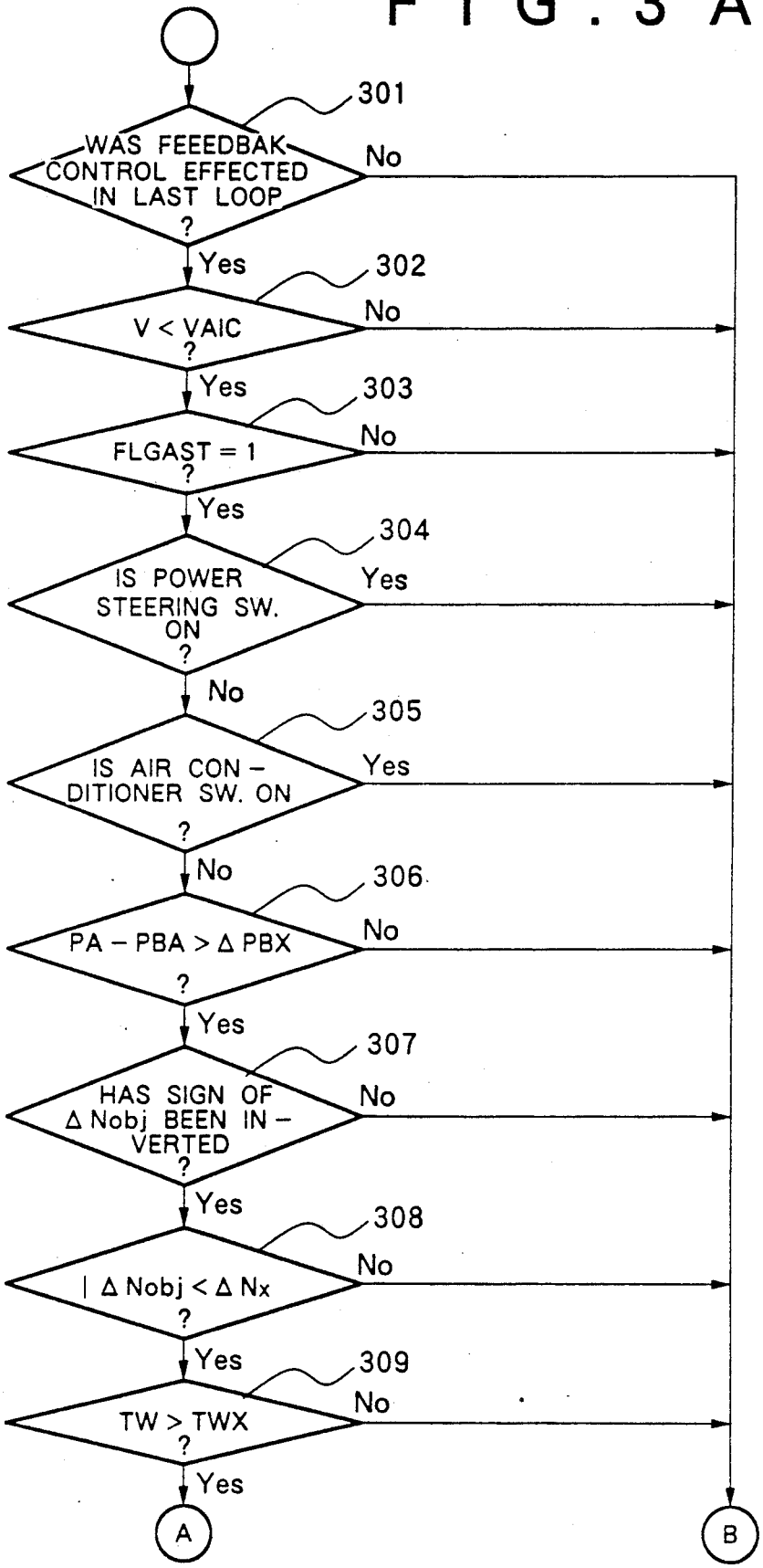
FIG. 3, comprised of FIG. 3A and FIG. 3B, is a flowchart of a subroutine for calculating a learned reference value $I_{XREF}$ of a control amount for controlling the intake air amount supplied to the engine.
Figure 3B:
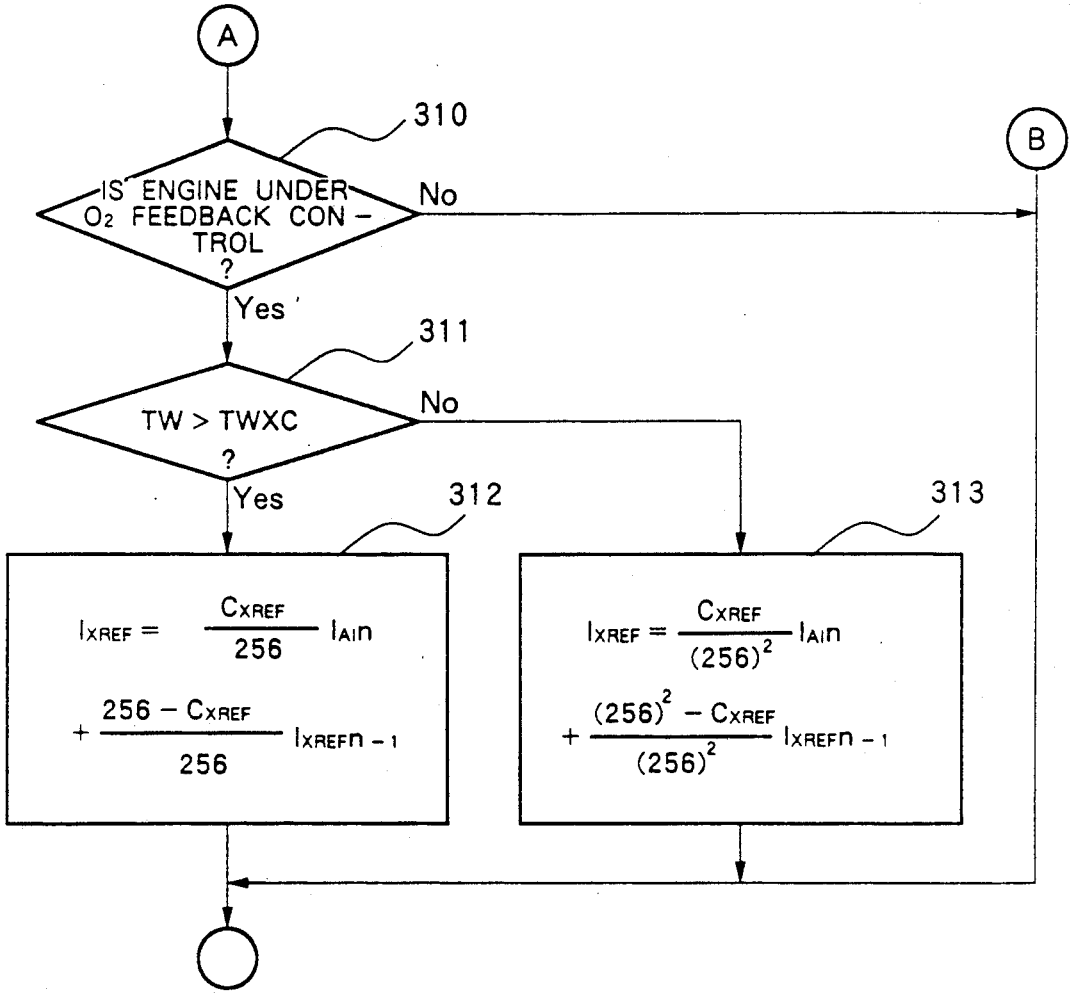
Figure 4:
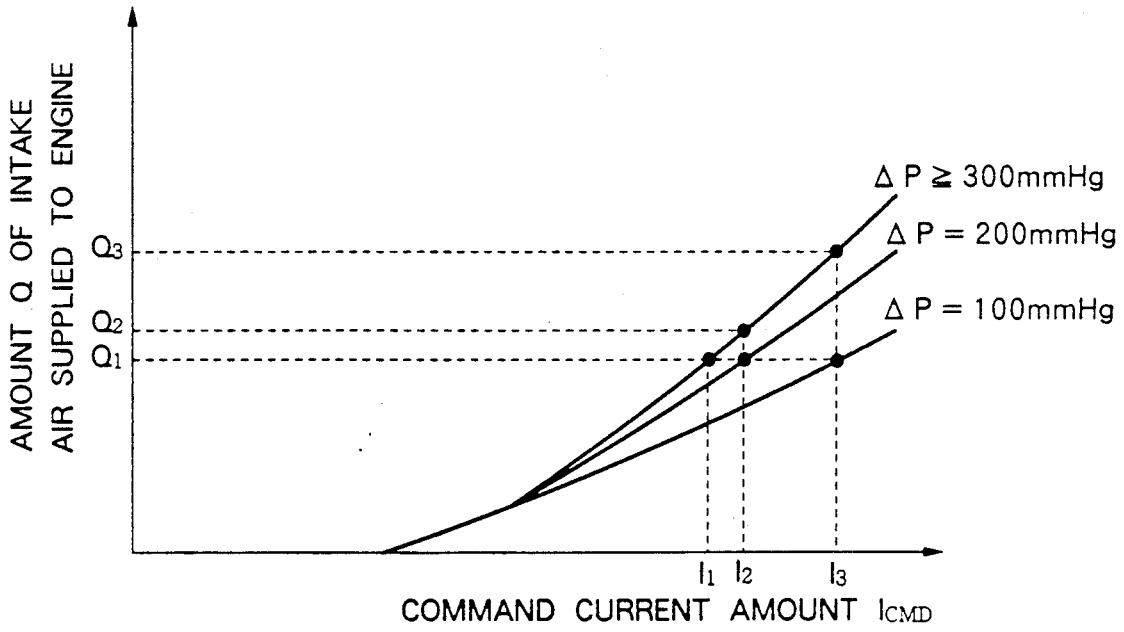
FIG. 4 is a graph showing the relationship between a command current amount $I_{CMD}$ for opening an auxiliary air amount control valve and the actual flow rate Q of intake air supplied to the engine.

FIG. 3 shows a subroutine for calculating the learned value or reference value $I_{XREF}$ of control amount, which is executed upon generation of each TDC signal pulse and in synchronism therewith.

At a step 301, it is determined whether or not the feedback control if the idling rotational speed was effected in the last loop. If the answer to the question of the step 301 is affirmative or Yes, that is, if the feedback control was effected in the last loop, the program proceeds to a step 302, wherein it is determined whether or not the vehicle speed V is below a predetermined value $V_{AIC}$ (e.g. 10 km/h). If the answer is affirmative or Yes, the program proceeds to a step 303, wherein it is determined whether or not a flag FLGAST is equal to 1. The flag FLGAST is set by a subroutine, not shown, in such a manner that it is set to 1 when warming-up of the engine has been completed, and otherwise, to 0. If the FLGAST has been set to 1, that is, if warming-up of the engine has been completed before the present loop, it is determined at a step 304 whether or not the power steering switch is on. If the answer is negative or No, it is determined at a step 305 whether or not the air conditioner switch is on. If the answer is negative or No, the program proceeds to a step 306.

At the step 306, it is determined whether or not the difference $\Delta P$ between atmospheric pressure $P_A$ and the intake pipe absolute pressure $\Delta P_{BA}(\Delta P = P_A - P_{BA})$ is larger than a predetermined value $\Delta P_{BX}$ (e.g. 150 mmHg). If the answer to the question of the step 306 is negative or No, the program is immediately terminated. This is by the following reason: As mentioned before, when the pressure difference $\Delta P$ is smaller than the predetermined value $P_{BX}$ during engine operation at low atmospheric pressure, the flow speed of air through the bypass passage 8 lowers to a much lower value than that during engine operation at normal atmospheric pressure, and the flow rate of air through the control valve 6 correspondingly lowers. In such a state, if the reference value $I_{XREF}$ is calculated to renew the learned valve at a step 312 or 313, hereinafter referred to, an improper or excessive amount of intake air will be supplied to the engine when the pressure difference $\Delta P$ becomes larger than the predetermined value $\Delta P_{XREF}$ during the next engine intake amount control by the control valve 6.

On the other hand, if the answer to the question of the step 306 is affirmative or Yes, the program proceeds to a step 307, wherein it is determined whether or not the sign of the difference $\Delta$Nobj between the desired idling rotational speed Nobj and the actual engine rotational speed Ne has been inverted. If the answer is affirmative or Yes, it is determined at a step 308 whether or not the absolute value of the difference $\Delta$Nobj is smaller than a predetermined value $\Delta N_X$. If the answer is affirmative or Yes, that is, if both the answers to the questions of the step 307 and 308 are affirmative or Yes, it is judged that the actual engine rotational speed Ne assumes stable values close to the desired idling rotational speed Nobj, and then the program proceeds to a step 309.

At the step 309, it is determined whether or not the engine coolant temperature $T_W$ is higher than a predetermined value TWX (e g. 50° C.). If the answer is affirmative or Yes, it is determined at a step 310 whether or not the engine is under air-fuel ratio feedback control ($O_2$ feedback control) based upon fuel injection control. If the answer to the question of the step 310 is affirmative or Yes, it is judged that all the conditions for calculation of the reference value $I_{XREF}$ of control amount of the control valve 6 are satisfied, and then the program proceeds to a step 311.

On the other hand, if any of the answers to the questions of the steps 301 to 303 and 306 to 310 is negative or No, or one of the answers to the questions of the steps 304 and 305 is affirmative or Yes, the program is immediately terminated without calculating the reference value $I_{XREF}$.

At a step 311, it is determined whether or not the engine coolant temperature $T_W$ is higher than a predetermined value TWXC (e g. 80° C.). Depending upon the result of this determination at the step 311, the reference value $I_{XREF}$ is calculated as the learned value by one of two different equations at the step 312 or the step 313.

If the answer to the question of the step 311 is affirmative or Yes, that is, if it is judged that the engine coolant temperature $T_W$ is higher than the predetermined value $T_{WC}$, a reference value $I_{XREF}$, having an ordinary effect of learning, is calculated by the following equation (2):

$$I_{XREF} = \frac{C_{XREF}}{256} \times I_{AIn} + \frac{256 - C_{XREF}}{256} \times I_{XREFn-1} \quad (2)$$

where $C_{XREF}$ is a variable which is experimentally set to a suitable value between 1 and 256, and $I_{XREFn-1}$ is an average value of $I_{AIn}$ obtained up to the last loop insofar as the engine coolant temperature TW is higher than the predetermined value $T_{WXC}$.

On the other hand, if the answer to the question of the step 311 is negative or No, that is, if the relationship $T_{WX} < T_W \leqq T_{WXC}$ holds, a reference value $I_{XREF}$, having an weakened effect of learning, is calculated by the following equation (3):

$$I_{XREF} = \frac{C_{XREF}}{(256)^2} \times I_{AIn} + \frac{(256)^2 - C_{XREF}}{(256)^2} \times I_{XREFn-1} \quad (3)$$

where the variable $C_{XREF}$ is identical with $C_{XREF}$ applied to the equation (2), and $I_{XREFn-1}$ is an average value of $I_{AIn}$ obtained up to the last loop insofar as the engine coolant temperature $T_W$ falls within the range of $T_{WX}$ to $T_{WXC}$.

The learned value $I_{XREF}$ obtained by the equation (2) or (3) is stored into a backup memory in the memory means 9c, followed by terminating the program.

As described above, when the difference $\Delta P$ between atmospheric pressure $P_A$ and the intake pipe absolute pressure $P_{BA}$ is smaller than the predetermined value $\Delta P_{BX}$, calculation of the reference value $I_{XREF}$ is inhibited. As a consequence, when the pressure difference $\Delta P$ once decreases and then returns to a normal range, there is no possibility that an improper amount of air is supplied to the engine at the start of the next feedback control of engine idling speed.

Although, in the above described embodiment, a special valve or control valve 6 is employed in an auxiliary air passage 8, to control the amount of intake air supplied to the engine during idling operation of the engine, the invention is not limited to this, but for example, the throttle valve 5 may be also used as a valve for controlling the engine idling speed, in a manner being electrically controlled by the ECU 6 through a mechanical actuator responsive to a control signal from the latter.

What is claimed is:

1. In an intake air amount control system for an internal combustion engine having an intake pipe, the system including valve means for regulating an amount of intake air supplied through said intake pipe to said engine, control means for determining a difference between a desired idling rotational speed of said engine and an actual rotational speed of same and feedback-controlling said valve means by means of a control amount responsive to the determined difference such that the actual rotational speed becomes equal to the desired idling rotational speed, and learning means for learning a reference value of said control amount, by calculating an average value of values of said control amount applied during said feedback control, the improvement comprising inhibiting means for inhibiting said learning of said reference value of said control amount when a difference between atmospheric pressure and absolute pressure within said intake pipe is smaller than a predetermined value.

2. An intake air amount control system as claimed in claim 1, wherein said valve means is a valve of a type adapted to open to a degree commensurate with a current amount supplied thereto, and said control amount comprises said current amount

3. An intake air amount control system as claimed in claim 2, wherein said valve means is a linear solenoid valve adapted to open to a degree proportional to said current amount supplied thereto.

4. An intake air amount control system as claimed in claim 3, wherein said engine has a throttle valve arranged in said intake pipe, and an auxiliary air passage bypassing said throttle valve, said linear solenoid valve being arranged in said auxiliary air passage for controlling a flow rate of air passing therethrough.

5. An intake air amount control system as claimed in claim 2, wherein said engine has a throttle valve arranged in said intake pipe, and said valve means comprises said throttle valve.

6. An intake air amount control system as claimed in claim 1, wherein said control amount is an integral term which is determined in response to a difference between the desired idling rotational speed and the actual rotational speed of said engine.

7. An intake air amount control system as claimed in claim 1, wherein the learned reference value of said control amount is applied as an initial value of said control amount at the start of said feedback control.

* * * * *